US006919840B2

(12) United States Patent
Friedrich et al.

(10) Patent No.: US 6,919,840 B2
(45) Date of Patent: Jul. 19, 2005

(54) INTEGRATION OF A SEMI-ACTIVE LASER SEEKER INTO THE DSU-33 PROXIMITY SENSOR

(75) Inventors: William A. Friedrich, Minnetonka, MN (US); Lyle H. Johnson, Bloomington, MN (US); Mark K. Conrad, Mound, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/301,522

(22) Filed: Nov. 21, 2002

(65) Prior Publication Data

US 2005/0030219 A1 Feb. 10, 2005

(51) Int. Cl.[7] ..... F42C 13/00; F42C 13/02; F42C 13/04; G01S 13/88

(52) U.S. Cl. ..... 342/68; 342/27; 342/52; 342/54; 342/118; 342/146; 342/147; 342/175; 342/195; 102/211; 102/213; 102/214; 102/396; 244/3.15; 244/3.16; 244/3.19

(58) Field of Search ..... 102/382, 396, 102/397, 211–214; 342/27, 28, 357.01–357.17, 61–68, 118, 128, 133, 134, 139, 140, 146, 147, 175, 192, 193–197, 52–59; 701/200, 207, 213–216; 244/3.1–3.3

(56) References Cited

U.S. PATENT DOCUMENTS 4,264,907 A * 4/1981 Durand, Jr. et al. ..... 342/53
4,324,491 A * 4/1982 Hueber ..... 224/3.16
4,492,166 A 1/1985 Purcell
4,576,346 A * 3/1986 Gauggel et al. ..... 224/3.16
5,260,709 A 11/1993 Nowakowski ..... 342/62
5,507,452 A 4/1996 Mayersak ..... 244/3.15
5,826,819 A 10/1998 Oxford ..... 244/3.14
5,943,009 A 8/1999 Abbott ..... 342/357.02
6,060,703 A 5/2000 Andressen
6,138,944 A 10/2000 McCowan et al. ..... 244/3.13
6,150,974 A * 11/2000 Tasaka et al. ..... 342/53
6,157,875 A 12/2000 Hedman et al.
6,237,496 B1 5/2001 Abbott
6,260,792 B1 7/2001 Zwirn et al. ..... 244/3.11
6,262,800 B1 7/2001 Minor
6,343,767 B1 2/2002 Sparrold et al. ..... 244/3.16
6,450,442 B1 9/2002 Schneider et al. ..... 244/3.14
6,626,396 B2 * 9/2003 Secker ..... 244/3.16

* cited by examiner

*Primary Examiner*—Bernarr E. Gregory
(74) *Attorney, Agent, or Firm*—Vidas, Arrett & Steinkraus, P.A.

(57) ABSTRACT

A proximity sensor for use with a guidance system of a smart bomb including a ranging radar proximity sensor configured for mounting on a smart bomb and a radome connected to the ranging radar proximity sensor. A laser radiation sensor system is attached to the proximity sensor, which is configured and arranged to detect laser radiation reflected from a target which passes through the radome and output the azimuth and elevation angles to the target to the guidance system.

30 Claims, 2 Drawing Sheets

INTEGRATION OF A SEMI-ACTIVE LASER SEEKER INTO THE DSU-33 PROXIMITY SENSOR

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to an improved proximity sensor and more specifically a proximity sensor with an integrated semi-active laser seeker for weapon guidance.

Smart munitions have used a variety of technologies to aid in guiding to a target. These technologies included inertial guided, infrared guided, radar guided, image guided, laser guided, GPS guided, and various combinations of these technologies.

U.S. Pat. No. 4,492,166 is an example of an infrared detector used to detect a target having a higher temperature than the background infrared radiation. U.S. Pat. No. 5,826,819 discloses a weapon system employing a bistatic radar guided transponder bomb and guidance method. U.S. Pat. No. 6,450,442 is an example of an impulse radar guidance system. U.S. Pat. No. 6,157,875 is an example of an image guided weapons system.

Laser guided patents include U.S. Pat. No. 6,138,944; U.S. Pat. No. 6,262,800, and U.S. Pat. No. 6,343,767. Laser guided systems can utilize either focused or unfocused sensor systems. The focused laser radiation sensor utilizes refracting and/or reflecting optical elements to focus incident laser radiation onto a sensor while the unfocused system utilizes a plurality of sensors (see U.S. Pat. No. 6,060,703 for example).

Global positioning system data (GPS) patents include U.S. Pat. No. 5,260,709; U.S. Pat. No. 5,507,452; U.S. Pat. No. 5,943,009, and U.S. Pat. No. 6,237,496.

Inertial and GPS coordinate based systems have inherent registration, bias and drift errors and also cannot be easily used on moving targets. Therefore, GPS systems are beginning to be utilized in combination with other systems to improve target accuracy. For example, the GBU-24E/B bomb uses a GPS system in combination with a laser-guided system. Other guidance system combinations are being used in combination as well. For example U.S. Pat. No. 6,060,703 uses optical energy, such as a laser designator in combination with a radio frequency (RF) system.

What is needed however is a way to combine several guidance systems inexpensively and so that the external profile of the weapon doesn't change.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

Applicants have integrated a semi-active laser seeker into their already existing commercially available DSU-33B/B proximity sensor. The DSL-33B/B proximity sensor is an all weather, battery operated, radio frequency, ranging radar proximity sensor which allows a weapon to be detonated at a desired height above the target. The DSU-33B/B has been used in connection with GPS guidance systems such as the JDAM guidance kit.

Incorporating a laser seeker into the DSU-33B/B utilizes the existing radome, which can either be modified to incorporate a laser aperture to allow laser radiation into the radome or the radome material can be selected to allow both RF and laser radiation to pass through the radome. The laser seeker can utilize either a focused or unfocused system and is most commonly used in connection with approximately 1 micrometer wavelength radiation.

Applicants have invented an improved proximity sensor which utilizes a focused laser radiation sensor. The proximity sensor is a ranging radar proximity sensor configured for mounting on a bomb and includes a radome. The laser radiation sensor is attached to the proximity sensor inside the radome and is configured and arranged to detect laser radiation reflected from a target, which passes through the radome. Optical elements are mounted inside the radome, and are configured and arranged to focus laser radiation which passes through the radome onto the laser radiation sensor. A processor electrically connected to the laser radiation sensor detects the presence of laser energy arriving from the target and derives the azimuth and elevation angles to the target for the purpose of guiding the weapon toward the target.

The laser radiation sensor may be a quadrant detector, and the processor processes a signal from each quadrant of the quadrant detector to detect the presence of incident laser energy and to derive the azimuth and elevation angles to the target.

The radome may either be transmissive to RF energy and laser energy or may be modified to include a laser aperture. The laser radiation has a wavelength of approximately 1 micrometer.

Applicant's have also invented an improved proximity sensor which utilizes an unfocused laser radiation sensor system attached to the proximity sensor which is configured and arranged to detect laser radiation reflected from a target which passes through the radome and output the azimuth and elevation angles to the target to the guidance system. The unfocused laser radiation sensor system is further comprised of a plurality of optical detectors arranged around a longitudinal axis of the proximity sensor, each optical detector on receiving incoming optical energy producing an optical detector output signal. At least one reflector is included which is constructed and arranged to reflect incoming optical energy onto at least one of the plurality of optical detector units, and a signal processor is electrically connected to the plurality of optical detectors for receiving the optical detector output signals and providing a guidance signal.

Applicant's inventive proximity sensor may be incorporated onto a smart weapon with a GSP guidance system, such as the JDAM guidance kit.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a preferred embodiment to the invention.

BRIEF DESCRIPTION OF THE SEVERAL VIEWS OF THE DRAWINGS

Referring to the Drawings, wherein like numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated. The concepts described above are considered to be read into the further description below.

Figure 1:
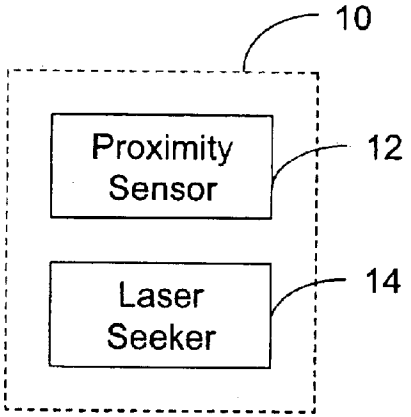
FIG. 1 is a block diagram showing the proximity sensor and laser seeker inside a radome.

FIG. 1 shows a radome at 10, and inside the radome is the proximity sensor 12 and laser seeker 14. The proximity sensor can be any proximity sensor such as the commercially available DSU-33B/B all weather, radio frequency ranging radar sensor sold by Alliant Techsystems. This sensor is modified in the invention to add the laser seeker 14, which can either be a focused system or unfocused system, such as the one disclosed in U.S. Pat. No. 6,060,703.

Figure 2:
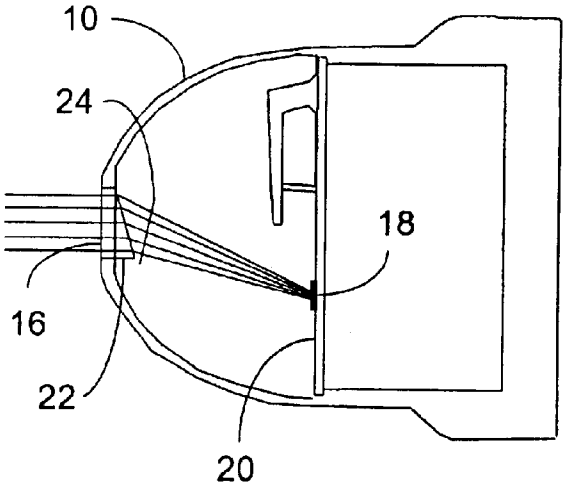
FIG. 2 shows a focused laser seeker system.

FIG. 2 shows a focused laser system inside radome 10, with a laser aperture 16 located in the radome, which allows laser radiation to pass into the radome. The optical energy is directed onto a laser sensor 18 by an optical system comprising laser aperture 16, prism 22, and lens 24. Lens 24 may either be formed by shaping the prism 22; lens 24 may be attached to the lower portion of prism 22, or lens 24 may be mounted in between the prism and the detector. Various specific embodiments of this optical system are possible to accept laser radiation, direct, and focus it onto the laser detector. A four-element (quadrant) or focal plane array sensor 18 which converts laser radiation to electrical signals is mounted on the antenna ground plane 20 of the proximity sensor. Laser seeker specific signal processing is added to the processor utilized by the proximity sensor of the DSU-33B/B. The signal from the laser sensor 18 is processed to derive the azimuth and elevation angles to the target reflecting the laser radiation. The derived azimuth and elevation angles are sent back to the guidance system (discussed below).

Figure 3:
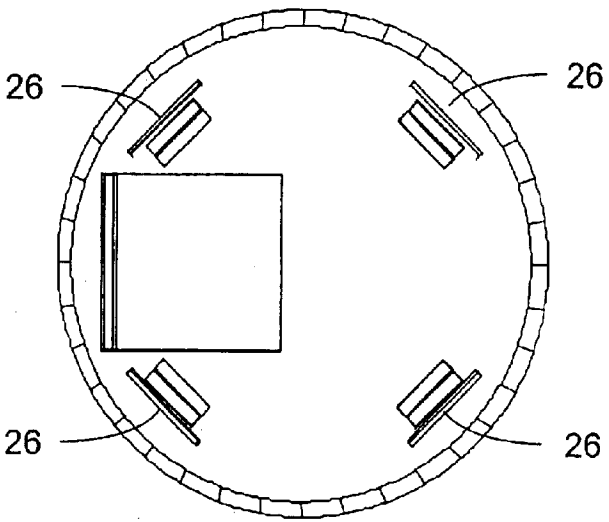
FIG. 3 shows an unfocused laser seeker system.

FIG. 3 shows a similar implementation for an unfocused laser seeker having four separate sensors 26 which receive the laser radiation and process it in accordance with the teachings of U.S. Pat. No. 6,060,703.

Figure 4:
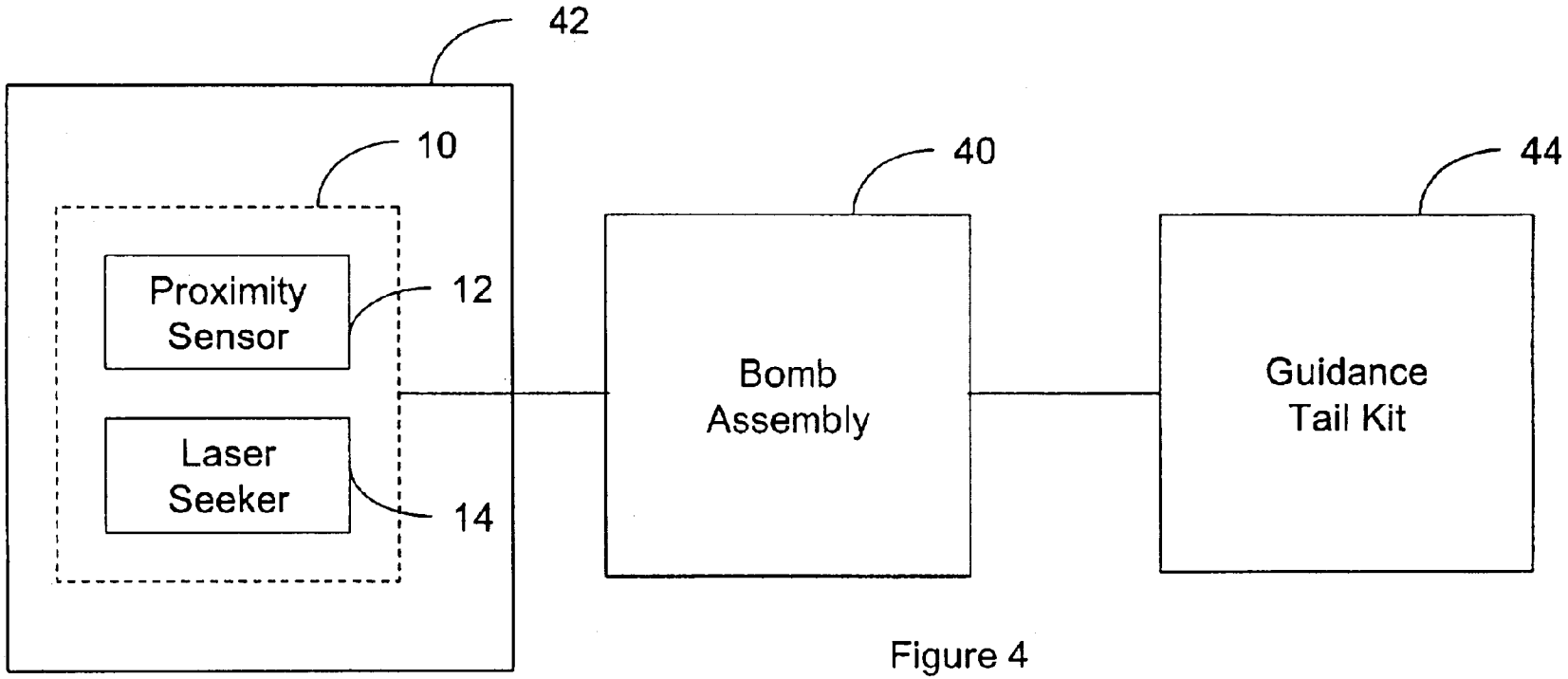
FIG. 4 is a block diagram showing a proximity/laser seeker kit and a GPS guidance kit, together with a bomb assembly.

FIG. 4 shows a block diagram of a bomb body assembly 40; the inventive proximity/laser system kit 42, which attaches on the front of the bomb, and a guidance tail kit 44, such as a JDAM kit, which straps onto the back of the bomb. Information is normally provided to the guidance tail kit prior to release of the weapon to set the desired target coordinates, flight trajectory, and similar initialization information. Additional means are provided to pass information from the guidance tail kit 44 to the proximity/laser system 42, including information on the laser designator code to be used with this weapon and the final fuzing mode to be employed at detonation. A laser energy detection signal and the measured target angles are fed back to the guidance system located in the guidance tail kit 44. The guidance system uses the target angles to refine the flight trajectory to insure the weapon hits the designated target. If an impact or delayed impact fuzing mode is selected, the proximity sensor 12 emits no fuze function signal to the weapon fuze. If proximity mode is selected, then the proximity sensor 12 does emit a fuze function signal to the weapon fuze when weapon height above ground is correct.

While not specifically detailed, it will be understood that the various electronic functional blocks are properly connected to appropriate bias and reference supplies so as to operate in their intended manner. It should also be understood that the processing described herein utilizes well-known technology. Further, any circuitry configurations and applications thereof other than as described herein can be configured within the spirit and intent of this invention.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A proximity sensor comprising:

a ranging radar proximity sensor configured for mounting on a bomb, the bomb having a guidance system for guiding the bomb to a predefined coordinate;

a radome connected to the ranging radar proximity sensor;

a laser radiation sensor attached to the proximity sensor inside the radome and configured and arranged to detect laser radiation reflected from a target which passes through the radome;

an optical assembly mounted inside the radome which is configured and arranged to direct and focus laser radiation which passes through the radome onto the laser radiation sensor;

a processor electrically connected to the laser radiation sensor and configured to derive the azimuth and elevation angles to the target.

2. The proximity sensor of claim 1 wherein the radome allows radio frequency electromagnetic energy and laser radiation to pass through the radome.

3. The proximity sensor of claim 2 wherein the laser radiation has a wavelength of approximately 1 micrometer.

4. The proximity sensor of claim 1 wherein the radome includes a laser aperture in the radome which permits laser radiation to pass through the laser aperture into the radome.

5. The proximity sensor of claim 4 wherein the laser radiation has a wavelength of approximately 1 micrometer.

6. A proximity sensor comprising:

a ranging radar proximity sensor configured for mounting on a bomb;

a radome connected to the ranging radar proximity sensor;

a laser radiation sensor attached to the proximity sensor inside the radome and configured and arranged to detect laser radiation reflected from a target which passes through the radome;

an optical assembly mounted inside the radome which is configured and arranged to direct and focus laser radiation which passes through the radome onto the laser radiation sensor;

a processor electrically connected to the laser radiation sensor and configured to derive the azimuth and elevation angles to the target;

wherein the laser radiation sensor is a focal plane array detector, and the processor processes a signal from the plurality of focal plane array detector elements to derive the azimuth and elevation angles to the target.

7. A proximity sensor for use with a guidance system of a smart bomb, comprising:

a ranging radar proximity sensor configured for mounting on a smart bomb, the smart bomb having a guidance system for guiding the bomb to a predefined coordinate;

a radome connected to the ranging radar proximity sensor;

an unfocused laser radiation sensor system attached to the proximity sensor which is configured and arranged to detect laser radiation reflected from a target which passes through the radome and output the azimuth and elevation angles to the target to a guidance system.

8. The proximity sensor of claim 7 wherein the radome allows radio frequency electromagnetic energy and laser radiation to pass through the radome.

9. The proximity sensor of claim 8 wherein the laser radiation has a wavelength of approximately 1 micrometer.

10. The proximity sensor of claim 7 wherein the radome includes a laser aperture in the radome which permits laser radiation to pass through the laser aperture into the radome.

11. The proximity sensor of claim 10 wherein the laser radiation has a wavelength of approximately 1 micrometer.

12. A proximity sensor for use with guidance system of a smart bomb, comprising:

a ranging radar proximity sensor configured for mounting on a smart bomb;

a radome connected to the ranging radar proximity sensor;

an unfocused laser radiation sensor system attached to the proximity sensor which is configured and arranged to detect laser radiation reflected from a target which passes through the radome and output the azimuth and elevation angles to the target to a guidance system;

wherein the unfocused laser radiation sensor system is further comprised of:

a plurality of optical detectors preferably arranged around a longitudinal axis of the proximity sensor, each optical detector on receiving incoming optical energy producing an optical detector output signal;

at least one reflector constructed and arranged to reflect incoming optical energy onto at least one of the plurality of optical detector units;

a signal processor electrically connected to the plurality of optical detectors for receiving the optical detector output signals and providing a guidance signal.

13. A smart bomb comprising:

a bomb;

a guidance system attached to the bomb for guiding the bomb to a predefined coordinate;

a ranging radar proximity sensor attached to the bomb;

a radome connected to the ranging radar proximity sensor;

a laser radiation sensor system attached to the proximity sensor which is configured and arranged to detect laser radiation reflected from a target which passes through the radome and output the azimuth and elevation angles to the target to the guidance system.

14. The smart bomb of claim 13 wherein the guidance system is a GPS guidance system.

15. The smart bomb of claim 13 wherein the laser radiation sensor systems is focused.

16. The smart bomb of claim 13 wherein the laser radiation system is comprised of:

a laser radiation sensor attached to the proximity sensor inside the radome and configured and arranged to detect laser radiation reflected from a target which passes through the radome;

an optical assembly mounted inside the radome which is configured and arranged to direct and focus laser radiation which passes through the radome onto the laser radiation sensor;

a processor electrically connected to the laser radiation sensor and configured to drive the azimuth and elevation angles to the target.

17. The smart bomb of claim 16 wherein the laser radiation sensor is a focal plane array detector, and the processor processes a signal from the plurality of focal plane array detector elements to derive the azimuth and elevation angles to the target.

18. The smart bomb of claim 16 wherein the radome allows radio frequency electromagnetic energy and laser radiation to pass through the radome.

19. The smart bomb of claim 18 wherein the laser radiation has a wavelength of approximately 1 micrometer.

20. The smart bomb of claim 16 wherein the radome includes a laser aperture in the radome which permits laser radiation to pass through aperture into the radome.

21. The smart bomb of claim 20 wherein the laser radiation has a wavelength of approximately 1 micrometer.

22. The smart bomb of claim 13 where the laser radiation sensor system is unfocused.

23. The smart bomb of claim 22 where the laser radiation sensor system is comprised of:

an unfocused laser radiation sensor system attached to the proximity sensor which is configured and arranged to detect laser radiation reflected from a target which passes through the radome and output the azimuth and elevation angles to the target to the guidance system.

24. The smart bomb of claim 23 wherein the unfocused laser radiation sensor system is further comprised of:

a plurality of optical detectors preferably arranged around a longitudinal axis of the proximity sensor, each optical detector on receiving incoming optical energy producing an optical detector output signal;

at least one reflector constructed and arranged to reflect incoming optical energy onto at least one of the plurality of optical detector units;

a signal processor electrically connected to the plurality of optical detectors for receiving the optical detector output signals and providing a guidance signal.

25. The smart bomb of claim 23 wherein the radome allows radio frequency electromagnetic energy and laser radiation to pass through the radome.

26. The smart bomb of claim 25 wherein the laser radiation has a wavelength of approximately 1 micrometer.

27. The smart bomb of claim 23 wherein the radome includes a laser aperture in the radome which permits laser radiation to pass through the laser aperture into the radome.

28. The smart bomb of claim 27 wherein the laser radiation has a wavelength of approximately 1 micrometer.

29. A proximity sensor comprising:

a ranging radar proximity sensor configured for mounting on a bomb;

a radome connected to the ranging radar proximity sensor;

a laser radiation focal plane array detector attached to the proximity sensor inside the radome and configured and arranged to detect laser radiation reflected from a target which passes through the radome;

an optical assembly mounted inside the radome which is configured and arranged to direct and focus laser radiation which passes through the radome onto the laser radiation sensor;

a processor electrically connected to the laser radiation sensor and configured to derive the azimuth and elevation angles to the target.

30. The proximity sensor of claim 29, wherein the laser radiation focal plane array detector comprises a four-element sensor.

* * * * *